United States Patent [19]

Price

[11] 4,033,076

[45] July 5, 1977

[54] CYLINDRICAL GRINDING MACHINE WITH WORKPIECE LOADER AND UNLOADER

[75] Inventor: Ralph E. Price, Waynesboro, Pa.

[73] Assignee: Landis Tool Company, Waynesboro, Pa.

[22] Filed: June 3, 1976

[21] Appl. No.: 692,703

[52] U.S. Cl. ..... 51/105 R; 51/215 R; 51/215 CP; 51/215 UE; 214/1 BD

[51] Int. Cl.[2] ..... B24B 41/00

[58] Field of Search ..... 51/215 R, 215 CP, 215 H, 51/215 UE, 103 WH, 105 R; 82/2.5; 214/1 BC, 1 BD, 1 BB

[56] References Cited

UNITED STATES PATENTS

| | | | |
|---|---|---|---|
| 3,226,886 | 1/1966 | Seidel | 51/215 R |
| 3,601,927 | 8/1971 | Kikuchi | 51/215 R |
| 3,619,951 | 11/1971 | Kikuchi | 51/215 R |
| 3,640,026 | 2/1972 | Flanigan | 51/215 R |

*Primary Examiner*—Al Lawrence Smith
*Assistant Examiner*—Nicholas P. Godici
*Attorney, Agent, or Firm*—Spencer T. Smith

[57] ABSTRACT

A cylindrical grinding machine comprising workpiece clamping means including a throwblock and a jaw member, a workpiece loader including workpiece engaging means, a workpiece unloader including workpiece engaging means, means for displacing the loader workpiece engaging means along an arcuate path from a retracted position to an advanced position whereat a workpiece will be placed in the throwblock, means for displacing the jaw member along an arcuate path from a retracted position to an advanced position whereat a workpiece may be clamped within the throwblock, and means for displacing the unloader workpiece support means along an arcuate path from a retracted position to an advanced position whereat the workpiece engaging means will engage a workpiece clamped within the workpiece clamping means, the arcuate paths of the jaw member and loader and unloader workpiece engaging means being substantially tangent at their advanced position to a single straight line.

5 Claims, 3 Drawing Figures

CYLINDRICAL GRINDING MACHINE WITH WORKPIECE LOADER AND UNLOADER

In a conventional loader for a cylindrical grinder such as is illustrated in U.S. Pat. No. 3,954,164, loading and unloading rams are selectively displaceable along linear, angularly offset paths. The angle at which a workpiece engages the throwblock of a clamping assembly of the cylindrical grinder will accordingly be different from the angle at which the workpiece disengaged from the throwblock and both of these angles will be different from the angle at which the clamp or jaw, associated with such a throwblock, forcefully urges the loaded workpiece into the throwblock. Improper clamping and workpiece removal may occur as a result of the very substantial differences between these angles.

It is accordingly an object of the present invention to provide a loader, having loading and unloading rams, for use with a cylindrical grinder, wherein the angle at which a workpiece engages a throwblock will be substantially the same as the angle at which the workpiece disengaged from the throwblock and wherein both of these angles will be substantially the same as the angle at which the throwblock jaw urges the workpiece into the throwblock to clamp the workpiece therein.

It is another object of the present invention to provide a loader having loading and unloading rams which are displaceable to elevate an unground workpiece to, and to lower a ground workpiece from a clamping assembly wherein the loading and unloading rams will be progressively accelerated then progressively decelerated between advanced and retracted positions, whereby the workpieces need not be locked in or otherwise physically secured to the loading and unloading rams.

Other objects and advantages of the present invention will become apparent from the following portion of this specification and from the accompanying drawings which illustrate in accordance with the mandate of the patent statutes presently preferred embodiment incorporating the principles of the invention.

Referring to the drawings.

Figure 1:
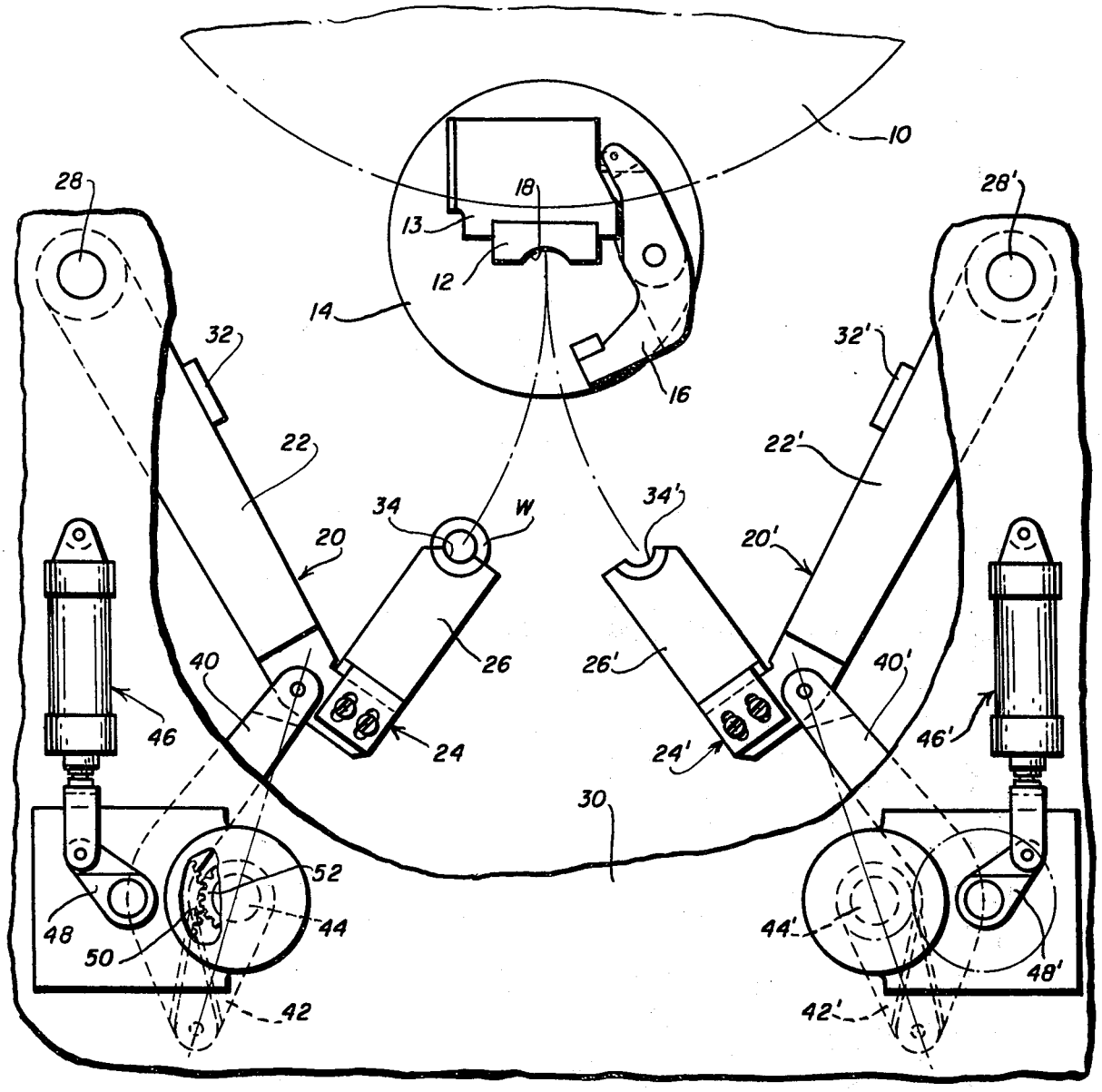
FIG. 1, is an elevational view of a loader assembly for a cylindrical grinder made in accordance with the teachings of the present invention.

The cylindrical grinder illustrated in FIG. 1 includes a grinding wheel assembly having a single rotatable grinding wheel 10 which may be selectively downwardly advanced into abrasive engagement with a selected portion of a workpiece W such as a crankshaft. The workpiece is clamped between at least one throwblock 12, which is supported by a base member 13 integrally secured to the drive plate 14 of a rotatable workhead, and an associated jaw member 16 which is pivotally secured to the base member 13.

The throwblock 12 includes a cylindrical workpiece receiving bearing surface 18. The configuration and direction of displacement of the jaw member are selected so that the jaw member, when clamping a workpiece in the throwblock will urge the workpiece substantially vertically upward (FIG. 2).

The loader assembly includes a pair of loading arms 20, each of which has a side member 22, an inwardly extending base member 24, and an upwardly extending work support member 26. The side members 22 are pivotally mounted on a shaft 28 secured to opposing side walls 30 of the loader assembly and are joined by a cross member 32 so that the loading arms will be movable as a unit. The base members 24 extend towards each other sufficiently so that the bearing surface portions 34 of the work support members 26 can support two spaced portions of the crankshaft W.

A pair of lift cranks 40 are pivotally connected to and extend between the bottom portion of the side members 22 and a pair of driven links 42, which are fixedly secured to a second shaft 44 extending between the side walls 30 of the loader assembly.

Figure 2:
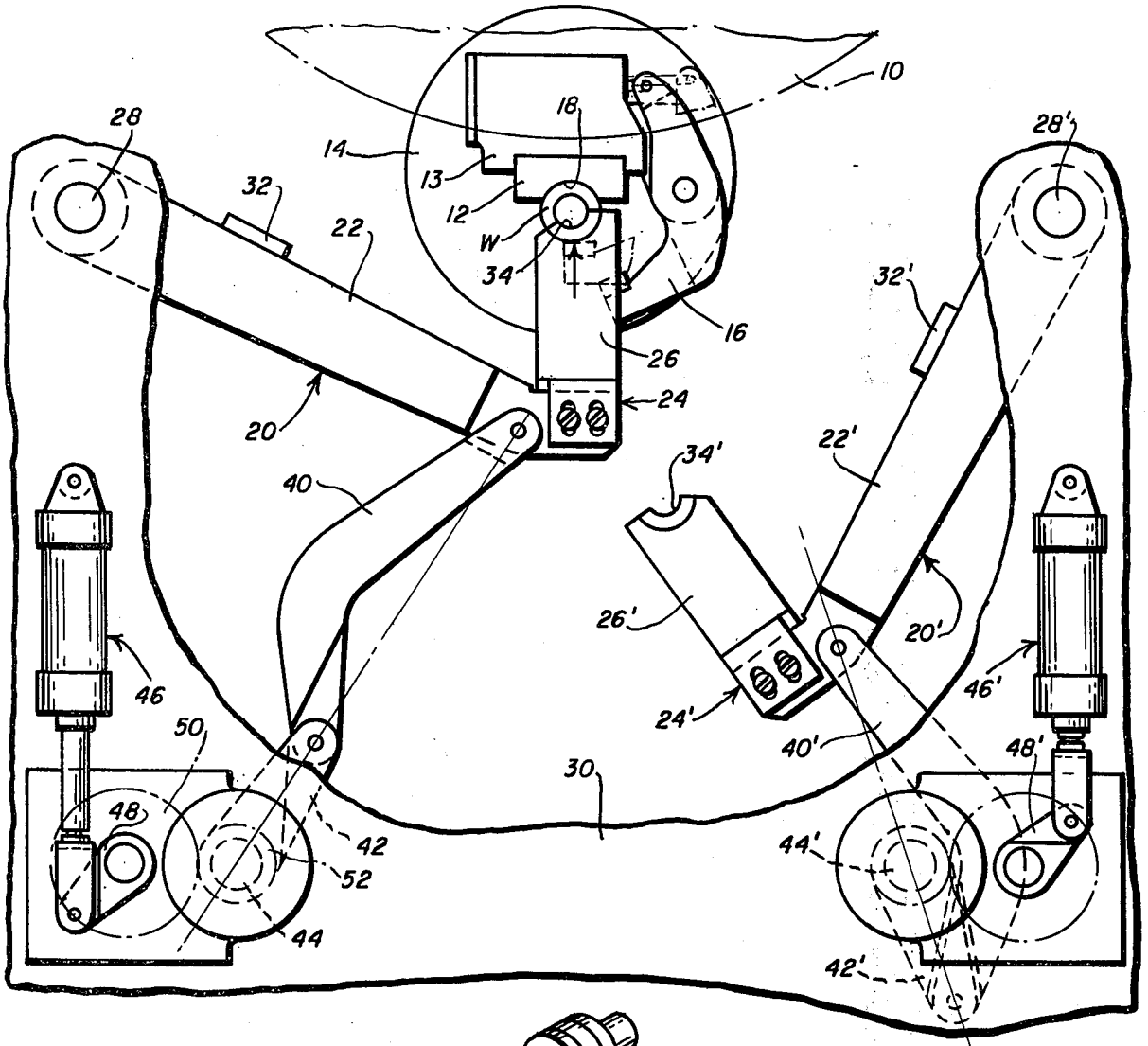
FIG. 2, is an elevational view of the loader assembly illustrated in FIG. 1, with the loading ram thereof in the fully advanced position.
Figure 3:
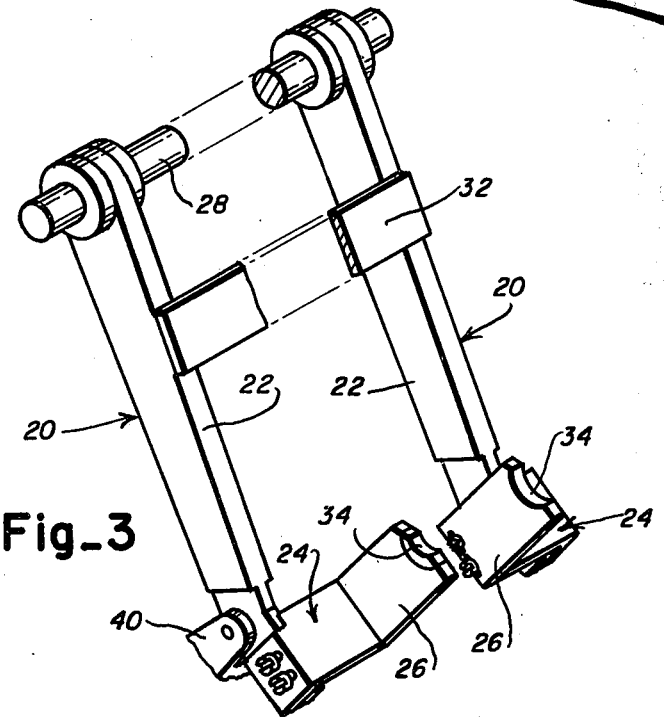
FIG. 3, is an oblique view of a portion of the loader assembly illustrated in FIG. 1.

The loading arm work support members 26 are advanced from a retracted position illustrated in FIG. 1 to an advanced position illustrated in FIG. 2 by means of a hydraulic cylinder 46 which is pivotally mounted on one end to one of the side walls and at the other end to a drive link 48 fixedly secured to a drive gear 50. The advancement of the hydraulic cylinder from its retracted to its advanced position will accordingly rotate the drive link 48 and associated drive gear 50 thereby driving a driven gear 52 and the driven links 42 which are secured to a second shaft 4 to displace the work support from its retracted to its advanced position.

The work support member 26 and the base member 24 are selectively adjustable to precisely locate a workpiece supported by the advanced loading arms, within the throwblock.

The structure of the unloading arms 20' and the mechanism for advancing the work support members 26' thereof from a retracted position illustrated in FIG. 2 to an advanced position (a mirror reversal of the loading arm work support illustrated in FIG. 2), are similar to the structure of the loading arms 20 and its advancing mechanism.

As can be seen from FIG. 1, the arcuate paths of the loading arm work support members 26, the unloading arm work support members 26', and jaw member 16, are substantially coincident (tangent to the same vertical line) at their advanced positions. The angle at which a workpiece engages the throwblock will accordingly be substantially the same as the angle at which a workpiece disengages from the throwblock and this angle will be substantially the same as the angle at which the jaw clampingly forces a workpiece into the throwblock. As a result, the loading of a workpiece into, the clamping of a workpiece in, and the removal of a workpiece from the throwblock can be precisely controlled.

By selectively loading the second shaft 44, 44' and the pivotal connections of the lift cranks 40, 40' to define a substantially straight line at the retracted and advanced work support positions, a workpiece being loaded into the clamping assembly will be gently displaced from the retracted position, subjected to progressive acceleration and deceleration and gently deposited within the throwblock. Similarly, a workpiece being unloaded from the clamping assembly will be gently removed from the throwblock, subjected to progressive acceleration and deceleration, and gently brought to rest at the retracted position.

Workpieces may accordingly be supported within the work supports of the loading and unloading arms without the necessity of locking the supported workpieces in the work supports.

What is claimed is:

1. A cylindrical grinding machine comprising workpiece clamping means including a throwblock and a jaw member, a workpiece loader including workpiece engaging means, a workpiece unloader including workpiece engaging means, means for displacing said loader workpiece engaging means along an arcuate path from a retracted position to an advanced position whereat a workpiece will be placed in said throwblock, means for displacing said jaw member along an arcuate path from a retracted position to an advanced position whereat a workpiece may be clamped within said throwblock, means for displacing said unloader workpiece engaging means along an arcuate path from a retracted position to an advanced position, whereat said workpiece engaging means will engage a workpiece clamped within said workpiece clamping means, said arcuate paths of said jaw member and loader and unloader workpiece engaging means being substantially tangent to a single straight line at their respective advanced positions.

2. A cylindrical grinding machine according to claim 1, wherein said loader displacing means comprises means for progressively accelerating and decelerating said loader workpiece engaging means as it is displaced from said retracted position to said advanced position.

3. A cylinder grinding machine according to claim 2, wherein said unloader displacing means comprises means for progressively accelerating and decelerating said unloader workpiece engaging means as it is displaced from said advanced position to said retracted position.

4. A cylinder grinding machine according to claim 1, wherein said loader displacing means comprises loader arm means, means for supporting said loader arm means for pivotal displacement, selectively rotatable driven arm means, lift crank means pivotally secured at opposing ends to said loader arm means and said driven arm means, the pivotal connections of said lift crank means and the axis of rotation of said driven arm means defining a substantially straight line when said loader workpiece engaging means is at said retracted and advanced positions.

5. A cylindrical grinding machine according to claim 4, wherein said unloader displacing means comprises unloader arm means, means for supporting said unloader means for pivotal displacement, selectively rotatable driven arm means, lift crank means pivotally secured at opposing ends to said unloader arm means and said driven arm means, the pivotal connections of said lift crank means and the axis of rotation of said driven arm means defining a substantially straight line when said unloader workpiece engaging means is at said retracted and advanced positions.

* * * * *